United States Patent [19]

Benz

[11] 4,427,567

[45] Jan. 24, 1984

[54] METHOD FOR RECONDITIONING OF POORLY FLOWING OR CAKED DETERGENT POWDERS

[75] Inventor: Claude L. Benz, Belle-Mead, N.J.

[73] Assignee: Colgate-Palmolive Company, New York, N.Y.

[21] Appl. No.: 275,052

[22] Filed: Jun. 18, 1981

Related U.S. Application Data

[63] Continuation of Ser. No. 640,792, Dec. 15, 1975, abandoned.

[51] Int. Cl.[3] ..... C11D 3/12; C11D 11/00; C11D 17/06

[52] U.S. Cl. ..... 252/116; 252/131; 252/140; 252/174.25; 252/383; 252/385

[58] Field of Search ..... 252/131, 135, 140, 174.25, 252/179, 383, 385, 116; 423/267

[56] References Cited

U.S. PATENT DOCUMENTS

| | | | |
|---|---|---|---|
| 3,290,158 | 12/1966 | Treat | 252/385 |
| 3,650,967 | 3/1972 | Johnson | 252/135 |
| 3,755,180 | 8/1973 | Austin | 252/99 |
| 3,838,072 | 9/1974 | Smith | 252/540 |
| 3,868,336 | 2/1975 | Mazzola | 252/527 |

FOREIGN PATENT DOCUMENTS

| | | | |
|---|---|---|---|
| 2538680 | 3/1976 | Fed. Rep. of Germany | 252/89.1 |
| 2283953 | 4/1976 | France | 252/89.1 |

OTHER PUBLICATIONS

*Chemicals Used in Food Processing,* Publication 1274, Nat. Academy of Sciences, National Research Council, 1965, p. 265.

Linde Molecular Sieve Bulletin: "Scavenging Water and Other Impurities with Molecular Sieves", Published by Union Carbide, Dec. 1971, 4 pp.

*Primary Examiner*—Dennis L. Albrecht

[57] ABSTRACT

Poorly flowing or caked detergent powders which include synthetic organic detergent, inorganic salt and moisture (with at least some of the moisture hydrating the salt) are reconditioned by mixing therewith a small proportion of hydratable molecular sieve zeolite, preferably of an initial moisture content of less than 3%. The reconditioned powders are free flowing, non-tacky and non-caking and the compositions resulting, rather than being less effective, have additional water softening and building properties due to the presence of the molecular sieve zeolite. Preferably, the molecular sieve zeolite employed is anhydrous and of type 4A and the detergent composition is a heavy duty non-phosphate product.

1 Claim, No Drawings

METHOD FOR RECONDITIONING OF POORLY FLOWING OR CAKED DETERGENT POWDERS

This is a continuation of application Ser. No. 640,792 now abandoned filed Dec. 15, 1975.

This invention relates to the reconditioning of poorly flowing or caked detergent powders. More particularly, it relates to a method for treating such powders with a non-phosphate compound which converts the powders to non-caked, freely flowing form without adversely affecting their detersive properties.

In the manufacture of particulate synthetic detergents builder and filler salts are usually employed and these are often capable of being hydrated. Thus, free moisture which may be in contact with the composition components can cause hydration of such builder salts and the hydrates may act as cements, holding particles together and making the product either lazy in flow properties, poorly flowing or at the worst, caking. Of course, such properties are undesirable for a product which is intended to be particulate and pourable from a dispensing container. Accordingly, efforts have been made to formulate detergent compositions so that they would either contain so little moisture that hydration and cementing would not be a problem. Alternatively, for any moisture present attempts have been made to have it consumed in hydrating any salts present before packaging. Also, to assist in maintaining the compositions in a free flowing state the globular or spherical bead form thereof produced by spray drying has been preferred. Additionally, it has been found that certain builder salts, primarily the polyphosphates, e.g., pentasodium tripolyphosphate, have the capacity to take up significant quantities of moisture without losing their free flowing properties and such builders, incorporated in detergent compositions, tend to make such compositions free flowing, too.

Despite formulation changes and particle shape designing to promote free flow, in storage detergent compositions are subjected to varying humidities and temperatures and often a result of such storage is the dehydration of previously hydrated salts and their subsequent hydration and cementing together to form a caked or poorly flowing product. Then too, the quantities of polyphosphate that may be contained in detergent compositions are being limited by law in an effort to prevent discharges of phosphates into inland lakes and streams, where, it is alleged, they have been contributory to eutrophication thereof. With the removal of polyphosphates from detergent compositions or with diminutions in the percentages thereof employed, other builders, such as silicates, which have greater tendencies to cause the caking of particulate materials with which they are present, have been employed in an effort to maintain a high level of built cleaning power. Also, the nonionic detergents that are frequently employed, which are normally oily liquids or waxy solids, tend to slow the flow of detergent powders. In view of various changes that have been suggested to improve the cleaning powers of detergent compositions, especially of the non-phosphate products, many of which have been effected in the formulating of detergents and because of uncontrolled storage conditions, whether in the final retail package or in storage prior to packaging, some detergent compositions are unsatisfactory, as manufactured, with respect to flow and caking characteristics. In the past, such products have been reworked back into the detergent product in small enough quantities so as not to make the final product poorly flowing. Alternatively, off-specification detergent product has been sent back to the soap kettles for at least partial utilization of its organic content. At the worst, it had to be scrapped.

It is sometimes difficult to work off off-specification detergent product because by the time it is discovered to be off-specification the run for that particular type of product might have been completed and therefore it would have to be held until such a product is made again or it would have to be blended in with a different type of product, where its components may adversely affect the desired product characteristics. The method of this invention allows economical, efficient and effective reworking or reconditioning of an off-specification detergent composition, which is tacky, poorly flowing or caked, and permits such a composition to be sufficiently effectively reconditioned so that it may be packed and sold and will be of satisfactory properties after storage, even when subjected to adverse atomospheric and storage conditions.

In accordance with the present invention a method for reconditioning poorly flowing or caked detergent powders comprising a synthetic organic detergent, an inorganic salt and moisture, a small proportion of which hydrates the salt to a caking, poorly flowing form, comprises mixing with such detergent powder from 0.5 to 10% of the weight thereof of a molecular sieve zeolite having the capability of being further hydrated by at least 10% of the weight thereof of moisture. In a preferred method the reconditioning is effected at about room temperature by tumbling the poorly flowing or caked detergent powder with the prescribed proportion of a type 4A anhydrous molecular sieve zeolite in finely divided powdered form for a period of 30 seconds to ten minutes in a rotating tubular container, the axis of rotation of which is nearer to horizontal than vertical. The preferred compositions treated are non-phosphate spray dried detergent powders comprising certain percentages of sodium dodecylbenzene sulfonate, sodium silicate, sodium sulfate, nonionic detergent, sodium higher fatty acid soap, sodium carboxymethyl cellulose and moisture.

The molecular sieve zeolites employed in the treatment of the poorly flowing or caked detergent compositions are water insoluble, crystalline aluminum silicate zeolites of natural or synthetic origin which are characterized by having a network of uniformly sized pores of very small size, e.g., about 3 to 10 Ångstroms, which size is uniquely determined by the unit structure of the zeolite crystal. Zeolites containing two or more networks of differently sized pores can also be employed. Amorphous forms of zeolites may also be useful but the crystalline forms, with pores of regular sizes, are better.

The molecular sieve zeolite employed is preferably also a univalent cation-exchanging zeolite, i.e., it should be an aluminosilicate containing a univalent cation such as sodium, potassium or lithium, when practicable, or of ammonium or hydrogen. Preferably, the univalent cation associated with the zeolite molecular sieve is an alkali metal, especially sodium or potassium, most preferably sodium.

Crystalline types of zeolites utilizable as molecular sieves in the invention, at least in part, include zeolites of the following crystal structure groups: A, X, Y, L, mordenite and erionite. Mixtures of such molecular sieve zeolites can also be useful, especially when type A zeolite, e.g., type 4A, is present. These preferred crystalline types of zeolites are well known in the art and are more particularly described in the text, *Zeolite Molecular Sieves,* by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the molecular sieve zeolite used in the invention is a synthetic molecular sieve zeolite. It is also preferable that it be of type A crystalline structure, more particularly described at page 133 of the aforementioned text. Especially good results are generally obtained in accordance with the invention when a type 4A molecular sieve zeolite is employed, wherein the univalent cation of the zeolite is sodium and the pore size of the zeolite is about 4 Angstroms. The especially preferred zeolite molecular sieves are described in U.S. Pat. No. 2,882,243, which refers to them as Zeolite A.

Molecular sieve zeolites can be prepared in either a dehydrated or calcined form, the latter form containing from less than about 1.5% to about 3% of moisture, or in a hydrated or water loaded form which contains additional adsorbed water in an amount up to about 20 to 30% of the zeolite total weight, depending on the type of zeolite used. Preferably, the anhydrous or partially hydrated zeolite molecular sieves are employed in the processes of this invention and it is preferable that they be able to sorb at least 10% of their weight in moisture, which can be removed from the poorly flowing detergent composition and can be incorporated into the crystalline structure of the molecular sieve zeolite. Most preferably, the anhydrous or substantially anhydrous form of the zeolite will be utilized, normally having a moisture content of less than 5%, preferably less than 3% and most preferably about 2% or even less. The manufacture of such crystals is well known in the art. For example, in the preparation of Zeolite A, referred to above, the partially hydrated or hydrated zeolite crystals that are formed in the crystallization medium (such as hydrous amorphous sodium aluminosilicate gel) are subjected to high temperature dehydration (calcined to 3% or less water content), which is normally practiced in preparing such crystals for use as catalysts, e.g., cracking catalysts. However, in some cases the high temperature dehydration may be suspended before dehydration is complete or the temperature to which the hydrated molecular sieve zeolite is raised for dehydration may be lower, thereby resulting in the production of a partially hydrated form of the zeolite which is of a desired moisture content, e.g., 8%, still capable of sorbing at least 10% (anhydrous basis) of moisture.

Usually the molecular sieve zeolite should be in finely divided condition such as crystals (amorphous or poorly crystalline particles may also find some use) having mean particle diameters in the range of about 0.5 to about 12 microns, preferably 5 to 9 microns and especially about 5.9 to 8.3 microns, e.g., 6.4 to 8.3 microns.

The synthetic organic detergents that are components of the detergent powders being reconditioned may be of the anionic or nonionic types. Although ampholytic and cationic detergents may sometimes be useful these are not usually employed in the present compositions. The anionic detergents employed normally have from 8 to 26, preferably from 12 to 22 carbon atoms per molecule and usually will include an alkyl or aliphatic chain containing about 8 to 18 carbon atoms, preferably from 10 to 16 carbon atoms, in a straight chain alkyl group. The most preferred of such detergents are the alkali metal higher alkylbenzene sulfonates, such as the sodium and potassium salts, in which the higher alkyl groups are of 10 to 18 carbon atoms, preferably 12 to 14 carbon atoms and preferably also are linear. Other such anionic detergents include the alpha-olefin sulfonates, paraffin sulfonates, ethoxylated alcohol sulfates, alkyl sulfates and sulfated higher alkyl phenyl polyoxyethylene ethanols, all preferably as alkali metal salts, such as the sodium salts. A list of such detergents is found in U.S. Pat. No. 3,637,339. Included within the group of anionic detergents are the higher fatty acid soaps, the sodium salts of fatty acids of 12 to 18 carbon atoms.

With the anionic detergents or in partial or complete replacement thereof there may be utilized nonionic detergents. These will normally be lower alkylene oxide condensation products, such as polyethylene oxides, which may sometimes have polypropylene oxide present but only to such an extent that the product is still water soluble. Preferred examples of such materials are the higher faty alcohol-polyethylene oxide condensates wherein the higher fatty alcohol is of 10 to 18 carbon atoms, preferably 12 to 15 carbon atoms and the ethylene oxide portion thereof is a chain of 6 to 30 ethylene oxide units, preferably 7 to 15 ethylene oxide units and more preferably about 10 to 15 ethylene oxide units. Also useful are similar ethylene oxide condensates of phenols, such as nonyl phenol or isooctyl phenol but these are not preferred.

The inorganic builder and filler salts will normally be water soluble salts of appropriate inorganic acids, the builder salts being those of silicic acids, boric acid, carbonic acids and polyphosphoric acids and the filler salts being those of sulfuric acids and hydrochloric acid. Of course, other inorganic acids may also be employed. Preferably, the salts will be alkali metal salts and of the alkali metal salts, although both sodium and potassium salts may be utilized, the sodium salts are preferred. The most preferred builder salts are sodium silicates and the most preferred filler salt is sodium sulfate. Sodium carbonate is also a very useful builder salt, as are pentasodium tripolyphosphate and borax. The salts act as carriers for the synthetic organic detergent(s) and they may also function to adjust the pH of the detergent solution. The silicates and phosphates exert water softening or sequestering effects, minimizing the production of insoluble and gelatinous soaps and of other calcium and magnesium compounds, such as the calcium and magnesium salts of the detergent acids, which may be undesirable or less active than the sodium salts in the wash water. The sequestrants are also especially useful to prevent iron stainings of any of the materials being washed. Various organic builders, such as sodium gluconate, tetrasodium ethylene diamine tetraacetate, trisodium nitrilotriacetate and sodium citrate may also be employed.

In addition to the detergent(s), builder(s), filler(s) and moisture, which is also present in the detergent composition to be treated by the method of this invention, the detergent compositions may contain various adjuvants well known for employment for in such products. Among the most important of these are the anti-redeposition agents, which aid in preventing redeposition of particulate materials on the laundry being washed. In particular, in the present case such materials are also important because they help to maintain suspended the molecular sieve zeolite which could otherwise deposit on dark colored laundry being washed and could appreciably mute such dark or strong colors, to change their appearance from one of high chroma and low value to one of higher value (in the direction of producing a pastel). Among the anti-redeposition agents which may be employed there may be mentioned sodium carboxymethyl cellulose (CMC), polyvinyl pyrrolidone, polyvinyl alcohol, hydroxypropyl methyl cellulose, hydroxyethyl ethyl cellulose and various other cellulose and starch derivatives and gums known to be useful for this purpose. Of these, CMC is highly preferred.

Among the other adjuvants that may be present in the detergent compositions that are to be treated by the method of this invention the most useful are fluorescent brighteners, colorants and perfumes and in many cases flow improving agents, such as clays will also have been incorporated (unsuccessfully, in the materials to be treated). The fluorescent brighteners include the various cotton brighteners, polyamide brighteners and polyester brighteners, which may be reaction products of cyanuric chloride and the disodium salt of diaminostilbene disulfonic acid, benzidine sulfone disulfonic acids, aminocoumarins, diphenyl pyrazoline derivatives or naphthotriazolylstilbenes, such as, for example, those sold under the names of Calcofluor ®, Tinopals ® RBS and 5BM and Phorwite ® BHC. Such materials are described in the article, *Optical Brighteners and Their Evaluation,* by Per S. Stensby, a reprint of articles published in *Soap and Chemical Specialties* in April, May, July, August and September, 1967, especially at pages 3–5 thereof, which are incorporated herein by reference.

With the mentioned components it may sometimes be desirable to include percompounds and activators for them in the detergent compositions. Among the percompounds that are useful are sodium perborate, usually as the tetrahydrate, sodium carbonate peroxide and sodium percarbonate. Activators for the percompounds are well known and assist in releasing oxygen from them to promote bleaching. Among such activators are those of both the triazine and acyl types, such as 2-[bis(2-hydroxyethyl)-amino]-4,6-dichloro-s-triazine (BHADT); 2,4-dimethoxy-6-chloro-s-triazine (DCT); diacetyl dimethyl glyoxime (DDG); and tetraacetyl glycoluril (TAG); all of which are mentioned in my other patent application of even date herewith, entitled Non-Caking Bleach. However, as mentioned in that application, some compositions which include a percompound, such as sodium perborate tetrahydrate, may be so hydrated that caking is incapable of being reversed by the methods of this invention. Accordingly, the content of percompound and especially of sodium perborate tetrahydrate, should be limited in the present compositions to no more than 20%, preferably no more than 10%; otherwise, irreversibility may be encountered (although the presence of the detergent component, CMC and any other organic materials may help to prevent irreversibility of the hydration crystal structure).

The various detergent compositions treated by the method of this invention may be made by admixing powdered compounds, co-size-reducing, drum drying, spray cooling or preferably, spray drying all of the composition components except those which are unstable to the described treatment or are most advantageously post-added. Thus, with respect to spray drying, any percompounds and perfume will be omitted from the crutcher mix and any clay to be employed to improve flow properties will be applied after completion of spray drying (and usually after addition of other post-added components).

Spray drying is normally effected by crutching the various components in an aqueous medium, usually at a solids content of 40 to 70%, preferably 50 to 70% and then spray drying the crutcher mix into heated drying air at a temperature of about 250° C., in a countercurrent (or concurrent) spray drying tower. The globular or bead-like product made may then be sieved or classified to be in a particular particle size range, usually such that over 95% and preferably 100% passes through a No. 8 U.S. Standard Sieve Series sieve and less than 10%, preferably less than 5% and most preferably 0% passes through a No. 140 sieve. More preferably the particle size range is between No. 10 and 100 sieves. The spray dried product is of a variety of shapes but most are rounded and approach the globular, thereby diminishing the number of contacting areas and helping to minimize caking. (In some instances molecular sieve zeolites such as those previously described may be included in the spray dried beads but often such zeolites, as a result of the crutching in an aqueous medium, may be partly or fully hydrated so as to be less efficient in sorbing moisture and preventing caking).

The proportion of molecular sieve zeolite employed, on the basis of the detergent powder to be treated, will be from about 0.5 to 10%, preferably about 1 to 5% and most preferably about 2% thereof. The proportion employed will usually depend on the amount of excess or free moisture in the product and the amount of moisture which has become crystallized or otherwise entrapped in the product components, usually the hydratable inorganic salts, and which cements particles thereof together or which plasticizes other components of the product. Normally, the proportion of moisture in the synthetic detergent composition that is causing caking and poor flow properties is only a proportion (and often a small proportion) of that present. Thus, when the moisture content of the detergent beads or other particles is up to 15%, usually 5 to 15% and often 5 to 10%, e.g., 7%, the proportion of moisture causing caking may be as little as from 0.05 to 2%, often 0.1 to 1%. Therefore, to sorb such "free" moisture and to extract such cementing moisture from the crystals of detergent components that cause caking the molecular sieve zeolite should have the ability to take up all such moisture. For example, if 2% of such moisture is present in the product and the molecular sieve zeolite employed has a total capacity of 22% of moisture and when admixed with the detergent composition, before sorbing any moisture, it contains 2% thereof, one would employ 10% of the molecular sieve zeolite to sorb all of the troublesome moisture of the detergent composition. Normally it is desired to have some excess unused dehydrating capacity in the zeolite. Therefore, it is considered that the zeolite should be capable of being further hydrated by at least 10% of its weight of moisture and preferably this figure is at least 15% and in some cases, 20% or more. Thus, 2% of an anhydrous type 4A molecular sieve zeolite, capable of being readily hydrated at 22% moisture, is able to sorb about 0.4% of moisture from a detergent composition with which it is admixed.

The taking up of moisture by the molecular sieve zeolite is facilitated by its small ultimate particle size and large surface area and also by the ability of the very fine particles to penetrate small interstices between and in the crystal structures to extract moisture therefrom and thereby to break the cemented bond and make the product more free flowing. The small molecular sieve particles tend to adhere to the surfaces of the product, thereby preventing dusting despite their small size and at the same time remaining in position to prevent further cementing between particles, even when water is released by decomposition of hydrates during storage and when storage is under humid conditions.

While the spray dried detergent product is a preferred one it is also within the present invention to treat granulated and other finely divided detergent compositions to prevent caking thereof. In such cases the particle sizes may be as small as 325 or 400 mesh up to 8 mesh but usually will be in the 140 to 250 or 325 mesh range.

The proportions of the various described components in the detergent compositions being treated will usually be about 10 to 30% of synthetic organic detergent, 30 to 75%, or 85% inorganic salt, of which 5 to 30% is preferably sodium silicate and 25 to 60% is preferably sodium sulfate and 5 to 10% of moisture. The synthetic anionic organic detergent content will generally be from 10 to 28%, preferably 15 to 25% and that of the nonionic detergent will be 1 to 20%, preferably 1 to 5%. When inorganic salts or builders in addition to the silicates and sulfate are present, the total of proportions thereof will usually be within the range of 2 to 20%, preferably 5 to 15% and the contents thereof will be at the expense of the sodium sulfate. The exception is pentasodium tripolyphosphate and when this is a desirable component of the present detergent products as much as 35% may be present, usually at the expense of the sodium sulfate content. Preferred contents of soap, anti-redeposition agent and other adjuvants (including fluorescent brighteners, clays, colorants and perfumes) will usually be in the range of 0.5 to 5%, 0.3 to 3% and 0.5 to 10%, respectively, preferably being from 0.5 to 2%, 0.5 to 2% and 0.5 to 5%, respectively. Usually the proportion of aluminum silicate or clay employed to improve flow properties (before treatment by the method of this invention) will be 0.5 to 3%, preferably about 1%.

When a detergent composition is found to be caked (preferably only lightly caked) or poorly flowing or has a tendency to become tacky on standing, which condition may be assessed by routine laboratory testing or by visual observation of the product by an experienced observer, and is to be reconditioned to be freer flowing, to prevent further caking on storage and to make the product salable and useful, it is a simple matter to admix with the composition to be treated a small proportion, e.g., 0.5%, of the anhydrous or partially hydrated and further hydratable molecular sieve zeolite. After addition of such a quantity and only about one minute's mixing in a normal inclined tumbling drum, preferably inclined nearer to the horizontal than to the vertical and more preferably inclined at an angle of 3° to 15° to the horizontal, a sample is taken and evaluated for flow properties and tendencies to cake. If it passes the test (a visual comparative test, which will be described later) the treated detergent composition may be packaged, shipped and sold but if it is still poorly flowing an additional 0.5% of the molecular sieve zeolite may be added. After following such procedure until a determination is made of the correct amount of the zeolite to be employed, further batches of the same run of detergent may be treated with the same proportion, without the necessity for individually testing each batch or, if desired, each batch may be tested and treated similarly. It will usually be found that about 1 to 5%, preferably 1 to 3% of the zeolite, especially if it is an anhydrous zeolite, will be sufficient to reverse the hydration (and plasticization, if also a problem) and make the product satisfactorily free flowing. Normally the tumbling time sufficient for satisfactory mixing and "de-cementing" will be from 30 seconds to ten minutes and preferably it is from 1 to 5 minutes. The temperature of the product at the time of admixing the zeolite with the lazy or caked detergent will preferably be about room temperature, 20° to 30° C. but may be in the range of 10° to 45° C. If the product is badly caked, before admixing of the zeolite with it it may be desirable to break up some of the larger lumps by mechanical action so as to aid penetration of the zeolite into the interiors of caked fragments.

The most preferred compositions treated by the method of this invention are non-phosphate detergent compositions containing anionic detergent, sodium silicate, CMC and sodium sulfate and in many cases, nonionic detergent, too. All such materials (with the possible exception of the sodium sulfate), contribute to a tendency for the detergent to become tacky and with the hydration effects of the inorganic salts, combined with the pastinesses or platicities of the other composition components, caking and poor flow properties often result. Yet, the described compositions often have to be made, to produce detergents which are of satisfactory cleaning properties, comparable to the phosphate detergents, and the production of such products is important when and where phosphates are not allowed in detergent compositions. Thus, the present method improves the physical properties of the preferred non-phosphate detergents sufficiently so as to make them marketable, which is an important technical advance in the art. Yet such improvement is done without adding very large quantities of a component which will significantly adversely change the characteristics of the detergent. Instead, the molecular sieve zeolites have little negative effect on the detergents and in fact, add another builder component thereto, thereby improving them in this respect. The molecular sieve zeolites are non-polluting, add no biological oxygen demand to the wash water being discharged to sewer and in the small proportions utilized in the present invention, in the presence of the anti-redeposition agent, do not objectionably deposit on laundry being washed.

The following examples illustrate the invention but are not to be considered as limiting. Unless otherwise mentioned all parts are by weight and all temperatures are in °C. in the examples and throughout this specification.

EXAMPLE 1

| COMPONENT | PERCENT |
|---|---|
| Sodium dodecylbenzene sulfonate (linear alkyl) | 23 |
| Sodium silicate ($Na_2O:SiO_2$ = 1:2.4) | 25 |
| Sodium sulfate | 40 |
| Sodium higher fatty acid soap (4:1 hydrogenated tallow:hydrogenated coconut oil) | 1 |
| Nonionic detergent (Neodol ® 45-11) | 1 |
| Sodium carboxymethyl cellulose | 0.5 |
| aluminum silicate (flow improving agent) | 1 |
| Adjuvants (fluorescent brightener, perfume, stabilizer, colorant) | 1 |
| Moisture | 7 |

The above product is made by spray drying a 60% solids aqueous crutcher mix of all the components except the perfume and aluminum silicate in a countercurrent spray drying tower with drying air at about 250° C. and the product resulting is cooled to room temperature, sprayed with perfume, mixed with flow improving agent and sieved so that it is of rounded, substantially globular particles which pass through a No. 8 U.S. Standard Sieve Series sieve and rest on a No. 140 sieve, with substantially all, more than 90% of the particles passing through a No. 10 sieve and resting on a No. 100 sieve.

Apparently because the presence of excess free moisture, which helps to plasticize some of the detergent composition components and hydrates the silicate thereof to cement some of the particles to others, caking and poor flow characteristics are noted after bin storage of the product for several hours. Thus, on a scale of 0 to 10, wherein 0 represents completely free flowing powder and 10 represents completely caked material, the present product is rated 8, 9 and 10 by different observers, making it unacceptable for packaging and sale in such a state.

The caked product is broken up into smaller pieces, most of which are of diameters less than one centimeter and in a continuous tumbling mixer, inclined about 8° to the horizontal, rotating at about 40 r.p.m., there is blended in with the detergent composition particles 2% of a substantially anhydrous (2% hydrated) type 4A molecular sieve zeolite, obtained from Henkel & Cie. and identified as HAB-100, of ultimate particle sizes in the 6.5 to 8.3 micron range. After tumbling for five minutes a sample of the product is taken and it is noticed that it is significantly improved in appearance, being more free flowing and of a lesser tendency to cake. Flow ratings of from 1 to 4 are obtained. Subsequently, such products and a control, which had previously been broken up and tumbled in the same manner as described above but without the addition of the molecular sieve zeolite, are observed and it is found that the control is comparatively poorly flowing and caked particles remain in it. Samples of the experimental and control products are placed in closed jars and are stored for seven days, after which time they are again examined. The experimental product is still free flowing, having flow ratings of about 1–3 and the control product is badly caked, with a rating of 10.

In variations of this experiment the molecular sieve zeolite employed is of 10% initial moisture content and 4% of it is utilized to make the product free flowing. Similarly, other anhydrous molecular sieve zeolites, all with moisture contents less than 5%, are substituted for the type 4A molecular sieve zeolite described, including a type 4A molecular sieve zeolite manufactured by Union Carbide Corporation, other type A molecular sieve zeolites and those of types X, Y and L and mixtures thereof. The flowabilities of the detergent product are noticeably improved with all such treatments.

In other modifications of the formulas the sodium linear dodecylbenzene sulfonate is replaced by sodium linear tridecylbenzene sulfonate and essentially the same results are obtained. Also, when the proportion of the linear higher alkybenzene sulfonate is lowered to 18%, the content of soap is increased to 3%, 5% of sodium carbonate is included, the proportion of ethoxylated alcohol nonionic detergent is increased to 2% and 4% with (half the nonionic detergent content being post-sprayed onto the tumbling detergent beads before application of the perfume) and the proportion of sodium carboxymethyl cellulose is increased to 1%, with the moisture content of the product being about 8% (the additions of materials are at the expense of the sodium sulfate), flow properties of the detergent are improved by the addition of 4% of the anhydrous molecular sieve zeolites mentioned. This is also the case when any one of sodium paraffin sulfonate, sodium alpha-olefin sulfonate, sodium higher fatty alcohol sulfate and sodium higher alkane sulfonate, having 12–16 carbon atoms each, is substituted, alone or in mixture, for half of the sodium higher alkylbenzene sulfonate detergent content. The desirable results reported are also obtained when the nonionic detergent and soap contents of the products are omitted.

In another variation of the experiments 8% of sodium perborate tetrahydrate is substituted for 8% of the sodium sulfate in the product, with the perborate being of particle sizes in the 140 to 250 mesh range and being post-added to the tumbling detergent composition beads before the perfume and flow improving agent. In such experiments the application of from 2 to 5% of the preferred 2% hydrated type 4A molecular sieve zeolite significantly improves the flow properties of the product.

In other variations of the experiments the proportions of the anionic detergent, sodium silicate, sodium sulfate, other components and moisture, of the detergent compositions and of the treating molecular sieve zeolites are varied ±10%, ±30% and ±50%, while still being w thin the ranges given in the preceding specification. The detergent compositions made, when found to be objectionably tacky, poorly flowing or caking, are noticeably improved in properties by admixing with them in the manner described the mentioned proportions of molecular sieve zeolite and the products made, often standing for times of one day to six months, are superior to "control" products not containing the post-added hydratable molecular sieve zeolites.

The various detergent compositions made, containing the post-added molecular sieve zeolite(s), are satisfactorily free flowing and non-caking and are good detergents. When employed at 0.15% concentration in cold or hot wash water of 150 p.p.m. hardness, as calcium carbonate (3:2 Ca:Mg hardness content, as calcium carbonate), at temperatures from 20 to 80° C., normally about 50° C., in top loading automatic laundry machines having tub volumes of about 80 liters, four kilogram washes comprising mixed cottons, cotton-polyester blends and permanent press fabrics, white and colored, are satisfactorily cleansed of normal organic, carbon and clayey soils without objectionable redeposition being apparent, whether the washed and rinsed laundry is line-dried or dried in an automatic laundry dryer.

EXAMPLE 2

| COMPONENT | PERCENT |
|---|---|
| Sodium linear tridecylbenzene sulfonate | 18 |
| Sodium silicate ($Na_2O:SiO_2$ = 1:2.35) | 15 |
| Sodium carbonate | 5 |
| Sodium sulfate | 50 |
| Ethoxylated alcohol (Plurafac B-26) | 1 |
| Sodium tallow soap | 1 |
| Aluminum silicate clay | 1 |
| Adjuvants (Tinopal 5BM Conc., fluorescent brightener, dye mixture, stabilizer, pigment and perfume) | 1.5 |

-continued

| COMPONENT | PERCENT |
|---|---|
| Moisture | 7.5 |

The above product, of particle sizes essentially the same as those described for the products of Example 1, when manufactured, is objectionably poorly flowing, with a tendency to cake. The caked product is treated sequentially with 0.5% additions of anhydrous molecular sieve zeolite of type 4A, of the characteristics previously given, and after six additions thereof (3%) a satisfactorily flowable product is obtained. This product is a good detergent, when tested by the practical wash method previously described, using a Gardner Color Difference Meter to detect improvements in washing actions. The product is as good as the control in washing power and is much more commercially acceptable. After one month storage it is still freely flowable.

On the basis of the preceding tests other portions of the run of unacceptably tacky and poorly flowing detergent composition of the formula given are treated with 3% of the molecular sieve zeolite and are correspondingly improved. Alternatively, various batches are independently tested and are all improved satisfactorily with the additions of from 2.5 to 3.5% of the anhydrous molecular sieve zeolite.

The mixing procedures of this example and of Example 1 are modified so that the temperatures of the detergent composition fragments being treated are 15° C., 25° C. and 40° C. In all such cases useful free flowing product results after treatments. This is also the case when the relative humidity is varied over the range from 20% to 80% during molecular sieve zeolite additions and storage periods. Similarly, variations in the mixing times from one minute to ten minutes produce a good product. Excessive mixing is not considered to be desirable because it may lead to breakdown of the distinctive bead structure of the detergent. Accordingly, the present methods, which can employ very short mixing periods to effect the treatment of the product, are highly desirable.

EXAMPLE 3

A particulate detergent of the formula of Example 1 is made but 25% of the sodium sulfate is replaced by pentasodium tripolyphosphate and the moisture content is increased from 7 to 9%. The product made is not sufficiently free flowing, although the presence of the pentasodium tripolyphosphate aids in maintaining such a product satisfactorily flowing at a lower (7%) moisture content. Accordingly, it is treated in the same manner as described in Example 1 with 4% of molecular sieve zeolite type 4A, as therein described, and is made free flowing and non-caking.

EXAMPLE 4

Products of the formulas given in Examples 1–3 are made in granular form, having particle sizes within the 140 to 250 mesh range. Such products cake worse than the spray dried products previously described but when twice the previously recited proportions of molecular sieve zeolites are added to them they become of improved flow properties and non-caking characteristics.

The invention has been described with respect to various illustrations and examples thereof but it is not to be interpreted as being limited to these because it is evident that one of skill in the art with this specification before him will be able to utilize substitutes and equivalents without departing from the spirit of the invention.

What is claimed is:

1. A method for reconditioning a caked detergent composition of about 18% sodium linear tridecylbenzene sulfonate, about 15% sodium silicate having an $Na_2O:SiO_2$ ratio of 1:2.35, about 5% sodium carbonate, about 50% sodium sulfate, about 1% of a C12 to C15 fatty alcohol-polyethylene oxide condensate having about 10 to 15 ethylene oxide units per molecule, about 1% sodium tallow soap, about 1% aluminum silicate clay, about 1.5% adjuvants and about 7.5% moisture, said percents being weight percents relative to the total weight of the composition, which comprises breaking up the caked detergent composition to form a detergent powder; and mixing about 100 parts of the detergent powder with about 3 parts of a type 4A molecular sieve having about 2% hydration and a particle size of about 6.5 to 8.3 microns to produce a molecular sieve coated, freely flowing detergent composition powder.

* * * * *